US005162093A

United States Patent [19]

Fournier et al.

[11] Patent Number: 5,162,093

[45] Date of Patent: Nov. 10, 1992

[54] DEVICE FOR OPENING AND CLOSING A VESSEL CONTAINING A METAL IN THE LIQUID STATE

[75] Inventors: Armand Fournier, Le Meux; Bernard Sans, Ribecourt, both of France

[73] Assignee: Aluminium Pechiney, Courbevoie, France

[21] Appl. No.: 796,793

[22] Filed: Nov. 25, 1991

[30] Foreign Application Priority Data

Nov. 26, 1990 [FR] France ..... 90 15178

[51] Int. Cl.[5] ..... B22D 41/14

[52] U.S. Cl. ..... 266/271; 222/597

[58] Field of Search ..... 266/271, 272, 236; 222/597, 598, 601

[56] References Cited

U.S. PATENT DOCUMENTS 1,401,072 12/1921 Haarmann ..... 266/272
2,426,644 9/1947 Van Der Pyl ..... 266/272
4,298,147 11/1981 Honda et al. ..... 266/272

FOREIGN PATENT DOCUMENTS 519155 6/1921 France .
944668 4/1949 France .
1061174 3/1967 United Kingdom .
2028474 4/1986 United Kingdom .

*Primary Examiner*—Scott Kastler
*Attorney, Agent, or Firm*—Dennison, Meserole, Pollack & Scheiner

[57] ABSTRACT

A device for opening and closing a vessel containing a metal in the liquid state. The device comprises a frusto-conical sealing stopper extended by a guide rod, and a means for maneuvering the sealing stopper including two arms of different lengths, which are parallel to each other in the position for closing the device, a first, movable connecting element to which the arms are rotatably joined at one end thereof, the first connecting element being fixed to the guide rod, and a second connecting element fixed to the lateral wall of the vessel, to which the arms are rotatably joined at the other end. The arms are arranged such that the shorter of the two arms is the further from the vessel while the apparatus is in the closed position.

3 Claims, 1 Drawing Sheet

DEVICE FOR OPENING AND CLOSING A VESSEL CONTAINING A METAL IN THE LIQUID STATE

BACKGROUND OF THE INVENTION

The present invention relates to a device for opening and closing a vessel containing a metal in the liquid state.

Before proceeding with pouring a metal or an alloy in order to mold it, one skilled in metallurgy knows that various stages first must be passed, from smelting the alloy through treatments for purifying the metal, and possibly transporting it to the pouring site.

All of these operations are done while the products are in the liquid state and accordingly require vessels such as melting, holding and treatment furnaces, or treatment or transport ladles for containing them.

Before being able to recover the contents of these vessels at the moment of pouring, for example, or any other transfer operation, recourse may be made to one of the following provisions: either to tilt the vessel, or to equip it with a plunger tube and exert a gas pressure on the surface of the metal, or to provide it with a pouring opening at its base, to which a sealing system such as a stopper or plug is adapted.

It is this last type of provision that the present applicant addresses in the instant application.

Generally, the opening that is made at the bottom of the vessel has the form of a truncated cone, with its wide base disposed toward the outside and its axis perpendicular to the lateral wall of the vessel.

The sealing stopper or plug, also of frustoconical shape, which in the prior art is solid with a lever, is engaged in into this opening. This lever is fixed at a point located in a vertical plane that passes through the longitudinal axis of the stopper and is moved by a rotational movement about this point, so that the stopper can be disengaged from the orifice to open the vessel or contrarily made to engage the orifice of the vessel to close it.

However, under these conditions, the stopper describes a circle, and its axis cannot remain parallel to the axis of the opening, which is horizontal. As a result, when a vessel that still contains metal is opened or closed, the stopper collides with the metal jet in an oblique rather than tangential direction, which causes spattering of metal; moreover, the end of the stopper has a tendency to rub against the walls of the opening, which slows down the opening or closing, and increases the period of time during which the spattering can be produced.

Accordingly, such a system entails risks to the safety of the workers. This is why applicant has sought and discovered a system with which these disadvantages can be overcome.

SUMMARY OF THE INVENTION

The invention comprises a device for opening and closing a vessel containing a metal in the liquid state, the lateral wall of which is provided with an opening at its base, the device being constituted on the one hand by a stopper for sealing the opening, taking the form of a truncated cone, the axis of which is extended towards its wide base by a guide rod, and on the other by a system for maneuvering said stopper, characterized in that said system is formed of four elements: two elements are arms and of different lengths, at least one of which is provided with a maneuvering handle, which are located in the same vertical plane and which in the position for closing the device are parallel to one another, have their lower ends rotatably joined to a third, horizontal element located in a vertical plane passing through the axis of the stopper and fixed on the guide rod, and a fourth element, rigidly fixed to the lateral wall of the vessel, located in the same plane as the horizontal element, and to which the upper ends of the arms are rotatably joined staggered with respect to one another in the direction of the height in such a way that the shorter arm is the farther from the vessel.

Thus these four elements form a trapezoid, which because of the presence of the axes of rotation is deformable. If a force is exerted on one of the arms, the effect of which is to move it farther away from the vessel while the system is in the closing position, then the two arms and the lower element will rotate around the upper element. However, in a first period of time, because of the disposition of the elements, the lower element will initially remain substantially horizontal, before describing a substantially circular trajectory. Because this particular characteristic occurs both during opening and during closing, the result is disengagement or engagement of the stopper parallel with the axis of the opening, and consequently the suppression of spattering, which is the object sought by the present applicant.

BRIEF DESCRIPTION OF THE DRAWING

The sole drawing Figure is a lateral view, partially in axial section, of an apparatus according to the invention.

DESCRIPTION OF THE PREFERRED EMBODIMENTS

Figure 1:
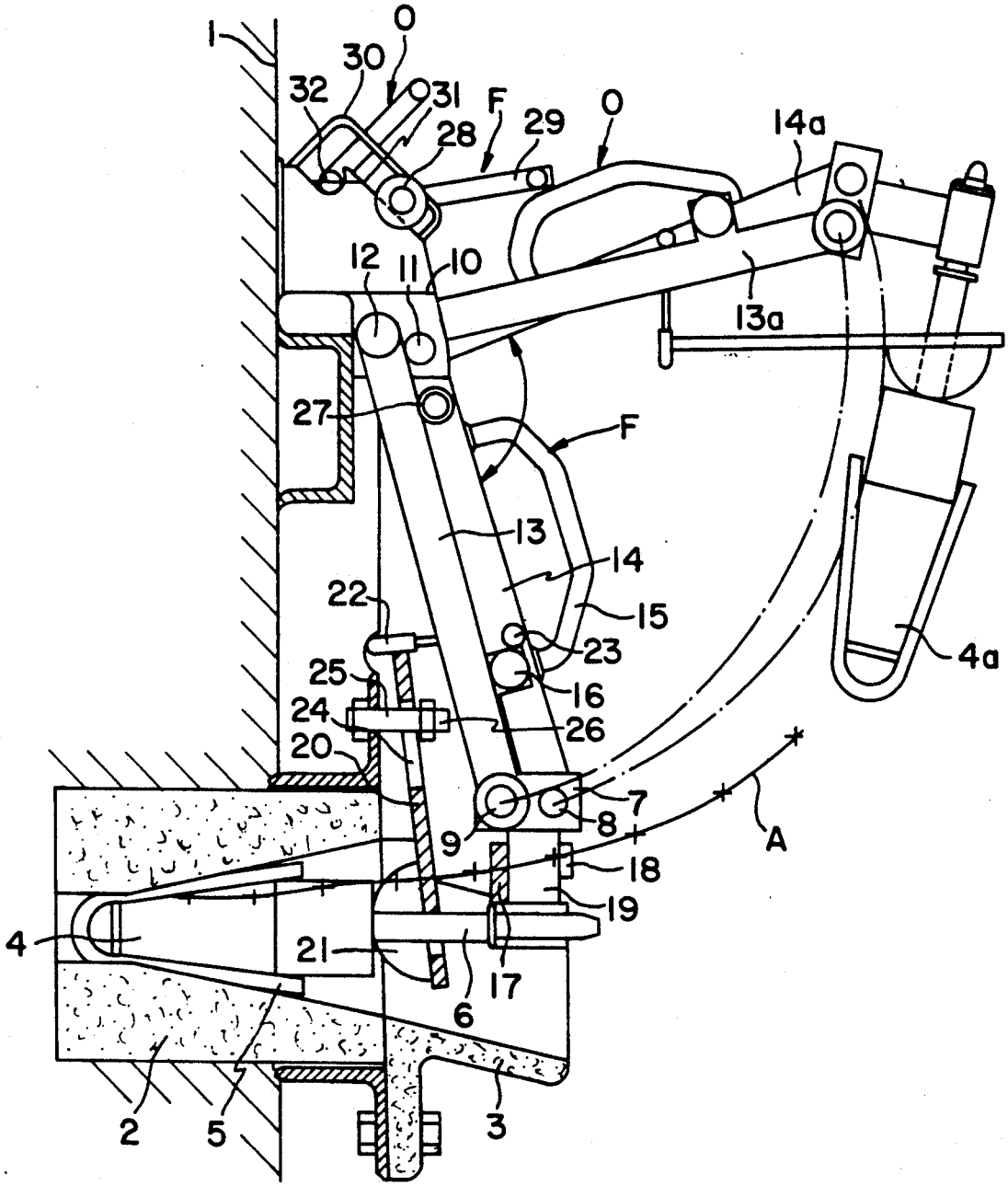

The drawing Figure shows a device of the invention in place on a vessel, both in a closed position marked F and in an open position marked 0. The lateral wall 1 of the vessel can be seen, provided with a conical opening 2 equipped with a refractory lining extended to the outside by a pouring spout 3. A frustoconical stopper 4 is placed inside this opening, and one of its ends is covered with a refractory felt 5, which assures tightness, and its other end is provided with a guide rod 6 to which a movable element 7 is fixed, the element 7 provided on its back side with a rotatable spindle 8 and on its front side with a rotatable spindle 9. The fixed element 10 is rigidly fixed to the lateral wall of the vessel and is also provided with an spindle 11 oriented toward the back and an spindle 12 oriented toward the front, the latter being upwardly staggered relative to 11. Located between the two elements are the arm 13, rotatably fixed onto the axes 9 and 12, and the arm 14, the shorter one, rotatably onto the axes 8 and 11 and provided with a handle 15.

The same elements are found in the open position, here marked with the same reference numeral, to which the index a is added.

In operation, when a shift is made from the closed position to the open position, the arms 13 and 14 describe a circular arc relative to their respective axes 12 and 11 and in their motion drive the element 7. However, at the beginning of the opening process, because of its relative freedom of motion and its geometrical position with respect to the arms, the element 7 remains substantially horizontal before describing a circular trajectory as represented by the curve A. Because of this, the stopper is disengaged from the opening in a direction practically parallel to its axis, which thus avoids the difficulties encountered with devices of the prior art, and in particular the problem of spattering.

This device may preferably be supplemented by appended means such as the following:

A supplementary carrying handle 16 fixed on the arm 13 perpendicular to the plane thereof.

A mechanism for locking the guide rod of the stopper in the closed position, including a plate 17 rigidly fixed to the vessel and onto which the portion 19 is to be fixed, with the aid of bolts, this part serving as a link between the maneuvering system and this rod.

A system for locking the device in the closed position, including a rod 20 provided with a cylindrical portion 21 that presses on the wide base of the stopper, a course limiter 22, and a means 23 for linkage with the arm 14, so as to be driven by this arm during its rotation. This rod is provided with an opening 24 that serves as a passage for the threaded end of a rod 25 fixed on the vessel, and to which a nut 26 is screwed, which makes it possible to lock the entire device.

For unlocking, the nut 26 need merely be removed.

This system has the advantage of assuring the closure of the stopper even in the case of intervention with the blocking system or the trapezoid.

A mechanism for locking the device in the open position, including a rocker bar, not shown, one of the ends of which is provided with an spindle 27 that engages the inside of the arm 14, and the other end of which is provided with an spindle 28 that is equipped with a lever 29, guided with the aid of a cap 30 and resting on an inclined plane 31 that ends at the top in a cutout 32, this plane being located in the upper portion of the fixed element 10.

In terms of operation, when the vessel is opened, the arm 14, in rising, drives the rocker bar and the spindle 28 upward, the spindle sliding along the inclined plane 31 and coming to rest in the cutout 32, where it is blocked in such a way that the system is locked in the upper position. For unlocking, it is sufficient to press on the lever 29, and the stopper resumes its place in the opening by the action of gravity. Under these conditions, the closure takes place rapidly; the shock between the stopper and the opening is buffered by the protective felt. This is practical in the event that a rapid interruption of pouring of liquid metal is desired because of problems upstream in the metal loop. The intervention on the part of the worker is then greatly reduced, and the risk is limited.

After the fast closure, the device can be reused to open the orifice normally.

Besides overcoming the disadvantages of the prior art, the device according to the invention and its appended means have the following advantages:

simple design and very great safety in operation;

a very reduced production cost;

ease of replacement of the protective felt of the stopper when the device is in the open position;

in the case of a ladle intended for trarsport, the fact that the weight of the device does not substantially change the commercial weight. Thus for a ladle that contains 7 metric tons of metal, the increase in weight does not exceed 16 kg.

Clearly, such a device, which is represented in a drawing with a manual maneuvering system, may be mechanized by employing an electric, pneumatic or hydraulic jack.

This device finds its application in any foundry and more particularly in the case of transport ladles, where it makes it possible to improve safety conditions.

What is claimed is:

1. An apparatus for opening and closing a vessel containing a liquid metal, the vessel including a lateral wall having a base portion with an opening therein, said apparatus comprising:

a stopper for sealing the opening in the form of a truncated cone having an axis extended outwardly from the vessel by a guide rod; and means for maneuvering said stopper movable between a first position in which said stopper seals the opening with the axis perpendicular to the lateral wall and a second position in which said stopper is removed from the opening, said means for maneuvering comprising two arms of different lengths, at least one of said arms being provided with a maneuvering handle, said arms being located in a common vertical plane and being parallel when said means for maneuvering is in said first position, a movable first connecting element to which said arms are rotatably joined at one end of the arms, said first connecting element being located in a vertical plane passing through the extended axis of the stopper, means fixing said first connecting element to said guide rod disposed perpendicular to the axis, a second connecting element located in the same vertical plane as said first connecting element and rigidly fixed to the lateral wall of the vessel, said arms being rotatably joined at the other end of the arms to said second connecting element, wherein said arms are arranged such that the shorter of the arms is the further from the vessel in the first position.

2. The apparatus of claim 1, additionally comprising means for locking said means for maneuvering in the first position.

3. The apparatus of claim 1, additionally comprising means for locking said means for maneuvering in the second position.

* * * * *